United States Patent [19]

Demetrescu

[11] 3,932,989

[45] Jan. 20, 1976

[54] RESONANT GAS-EXPANSION ENGINE WITH HYDRAULIC ENERGY CONVERSION

[76] Inventor: Mihai C. Demetrescu, 17761 Palmento Way, Irvine, Calif. 92664

[22] Filed: July 1, 1974

[21] Appl. No.: 484,739

Related U.S. Application Data

[62] Division of Ser. No. 314,211, Dec. 11, 1972, Pat. No. 3,848,415.

[52] U.S. Cl. ..... 60/327; 60/374; 60/381; 60/383; 60/721; 417/379; 417/380; 417/392; 123/46 A; 123/46 SC; 123/46 R; 92/107; 92/137; 92/149

[51] Int. Cl.[2] ..... F04B 17/00

[58] Field of Search ..... 60/374, 327, 381, 383, 60/520, 595; 92/130, 132, 134, 149; 91/183, 346; 123/46 A, 46 SC, 46 R; 417/379, 380, 392

[56] References Cited

UNITED STATES PATENTS

| | | | |
|---|---|---|---|
| 3,012,549 | 12/1961 | Bard et al. | 123/46 X |
| 3,023,564 | 3/1962 | Tenney et al. | 123/46 X |
| 3,643,638 | 2/1972 | Braun | 123/46 R |

*Primary Examiner*—Allen M. Ostrager
*Attorney, Agent, or Firm*—Nilsson, Robbins, Bissell, Dalgarn & Berliner

[57] ABSTRACT

An illustrative system is disclosed for use as a rotary-drive engine, utilizing combustible fuel and a hydraulic system of energy conversion. An engine block defines a pair of expansion cylinders (combustion chambers) and an associated concentric pair of hydraulic chambers. The chambers matingly receive unitary piston structures for phase-opposed reciprocal movement.

The hydraulic working chambers communicate with each other and can exhaust high pressure fluid through a control valve structure for drive power. Exhausted fluid is replaced in volume by low-pressure spent fluid. The body of the fluid contained in the hydraulic working chambers along with the piston means and springs connected to the engine block define an oscillatory system which is resonant at the operating frequency. That consideration, along with the absence of lateral loads on the pistons, results in relatively high efficiency.

In the system, as disclosed, fluid under pressure is delivered from the hydraulic working chambers through a control valve to actuate a turbine in accordance with the immediate power demand. The supply and combustion of the fuel to provide power strokes is controlled in accordance with power demand and is synchronized with the current displacement of the piston means at the frequency of mechanical resonance. Thus, a reciprocating expansion motive system, e.g. internal combustion engine, is disclosed with low energy losses from inertial and lateral forces due to maintaining mechanical resonance which results in improved efficiency as for converting fuel into hydraulic energy. As disclosed herein, the hydraulic energy is employed to drive a turbine.

6 Claims, 7 Drawing Figures

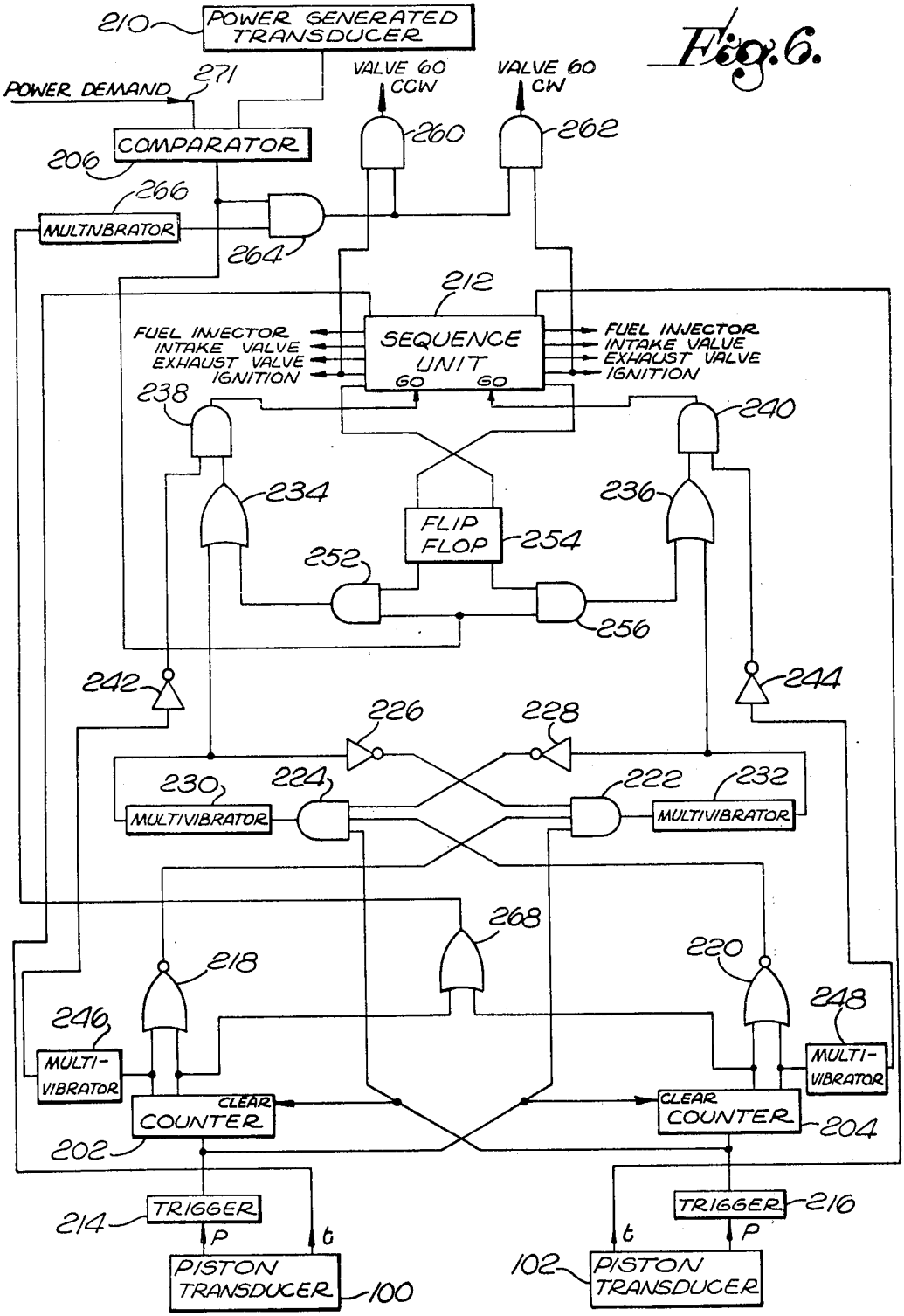
Fig. 6.
POWER GENERATED TRANSDUCER
210
POWER DEMAND
271
VALVE 60 CCW
VALVE 60 CW
COMPARATOR
206
260
262
266
MULTIVIBRATOR
264
212
SEQUENCE UNIT
FUEL INJECTOR
INTAKE VALVE
EXHAUST VALVE
IGNITION
GO
GO
FUEL INJECTOR
INTAKE VALVE
EXHAUST VALVE
IGNITION
238
240
234
236
FLIP FLOP
254
252
256
242
244
226
228
230
224
222
232
MULTIVIBRATOR
MULTIVIBRATOR
268
218
220
246
248
MULTI-VIBRATOR
MULTI-VIBRATOR
CLEAR
COUNTER
CLEAR
COUNTER
202
204
214
TRIGGER
P
t
TRIGGER
216
t
P
PISTON TRANSDUCER
100
102
PISTON TRANSDUCER

RESONANT GAS-EXPANSION ENGINE WITH HYDRAULIC ENERGY CONVERSION

This is a division, of application Ser. No. 314,211, filed 12-11-72, now U.S. Pat. No. 3,848,415.

REFERENCE

This application incorporates subject matter of a Disclosure Document No. 009927, filed in the United States Patent Office on Apr. 5, 1972, and Disclosure Document 014144 similarly filed on Oct. 16, 1972.

BACKGROUND AND SUMMARY OF THE INVENTION

In recent years there has been a considerable technological effort directed toward the development of an improved engine, as for automotive use. A primary specific objective in that regard has been an engine that is less polluting than conventional structures. Of course, important secondary improvements also have been sought, including reduced size, economy of manufacture and low maintenance cost.

Generally, internal combustion engines of conventional design are characterized by important though unavoidable energy losses resulting from inertial forces that are developed in the reciprocating parts, and lateral friction forces existing between pistons and cylinder walls. Of course, to a large extent, the volume of pollutants resulting from the operation of an engine is related to the overall efficiency of the engine. Fuel consumption while an engine idles (between periods of providing drive power) also is significant in relation to the engine as a source of pollutants.

Although various forms of engines have been suggested for automotive use, and certain forms have been developed to operational stages, their production necessitates extensive new tooling and tends to render obsolete vast quantities of technical knowledge and tooling, as well as marketing techniques and facilities. Accordingly, a considerable need exists for an improved and less-polluting system to provide mechanical energy from combustible fuels, as are readily available through existing marketing facilities. In general, the present invention is responsive to the considerations set forth above; may be embodied in a form that is adaptable to existing tooling and would relate effectively to widely-disseminated technical information. The present motive system may be embodied in a V-configuration internal-combustion engine, various forms of which are in widespread production and which are accommodated by the broadly disseminated maintenance and technical information.

In general, the system of the present invention utilizes the energy of an expansion cycle, e.g. the combustion of fuel in a mixture with air. The system operates under somewhat constant conditions, and may be embodied as an efficient, non-polluting unit. The relatively consistent operating conditions are maintained as a result of operation at the frequency of mechanical resonance. For example, in the disclosed embodiment, the associated piston means on each side of a V-configuration engine reciprocates in phase opposition at a resonant rate. That is, the movement of the piston means is supplemental or phase opposed in that while one piston is traveling downwardly, the other or supplemental piston is moving in an upward direction. As indicated, the piston means include springs and are intercoupled to result in an oscillatory mechanical system that is resonant at the operating frequency so as to establish a substantially constant set of operating parameters.

Each of the piston means in the disclosed embodiment incorporates a combustion piston and an hydraulic piston. The hydraulic pistons act upon a column or body of fluid, e.g. oil, that is contained in a space between them. One function of the body of fluid is to intercouple the piston means. Also, additional coupling means, as a mechanical connection, may be employed.

As indicated, energy is provided from the motive system in the form of hydraulic fluid under pressure, flowing from the body of fluid between the supplemental piston means. A valve is provided to permit external flow in accordance with current demand. In the illustrative embodiment, the fluid actuates a turbine, to rotate a mechanical shaft. The spent fluid from the turbine is returned to replace the volume of high-pressure fluid that is exhausted.

Control of the valve structure as well as the intake and exhaust valves of the engine, and fuel injection and ignition in the illustrative embodiment, is accomplished by a control system with input information including current power demand, current power output and the current amplitude of piston displacement.

In alternative embodiments of the system, several engine configurations may be employed utilizing various numbers of piston pairs associated in various relationships. Also, various fuels and cycles are readily adaptable to the motive system. Specifically, for example, the system may embody principles of various engines including: internal combustion, steam, air and so on. However, the extensive body of knowledge, production facilities and distribution establishments relating to V-configuration gasoline engines (Otto cycle) results in such a configuration being relatively attractive for production in the near future. Accordingly, the disclosed embodiment is in such a form.

BRIEF DESCRIPTION OF THE DRAWINGS

The drawings, disclosing an illustrative embodiment of the present invention, and which serves to present the various objectives and advantages hereof, are as follows:

FIG. 6 is a logic diagram of the control unit incorporated in the system of FIG. 1.

DESCRIPTION OF THE ILLUSTRATIVE EMBODIMENT

The disclosed embodiment exemplifies the invention which may, of course, be embodied in other forms, some of which may be radically different from the illustrative embodiment. However, the specific structural and functional details disclosed herein are representative and provide the basis for the claims herein which define the scope of the invention.

Figure 1:
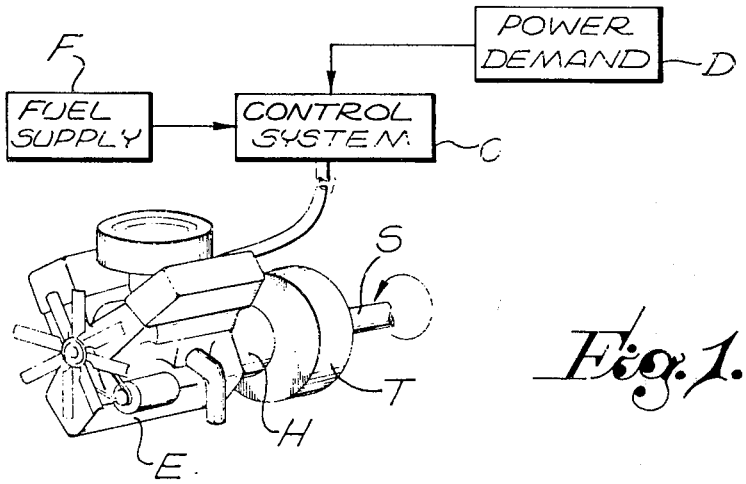
FIG. 1 is a perspective and diagrammatic view of an embodiment of the present invention.

Referring initially to FIG. 1, there is represented an embodiment of the present invention which functions to receive combustible fuel from a supply F, and to provide rotary power at a shaft S. The fuel from the supply F passes through a control system C to an engine unit E in which the fuel is burned to provide expanding gases for actuating internal spring-mounted pistons (not shown in FIG. 1). Rather than acting through conventional rods or other couplings, the spring-mounted pistons in the engine unit E act on a body of partially-confined hydraulic fluid. Thus, the spring-mounted pistons in the engine unit E are hydraulically intercoupled and operate in supplemental pairs at a frequency of mechanical resonance. To supply power demands, hydraulic fluid under pressure is passed from the fluid body in the engine unit E through hydraulic ducts H to a turbine T. The hydraulic fluid thus actuates the turbine T to drive the shaft S. Spent hydraulic fluid from the turbine T is returned to the engine unit E through the hydraulic ducts H, thereby affording a closed hydraulic system.

During intervals when the motive system is "idling" (operative, however, with no useful power output) the engine unit E receives limited fuel through the control system C to maintain resonant oscillation of the pistons. For example, during an idling state, a single power stroke may be followed by many non-power oscillatory strokes of reducing displacement until another power stroke is commanded to sustain a desired minimum displacement or stroke amplitude.

The motive system can be actuated by a signal from a power-demand unit D which may simply comprise a manually-operated, analog-signal source. With the demand for output power, fuel is supplied from the supply F through the control system C to the engine unit E. Somewhat concurrently, a valve structure in the engine unit E is opened (by the control system C) so that the pistons operate as pumps in a closed loop to actuate the turbine T. In view of the above preliminary considerations, the illustrative system will now be treated in greater detail, with an explanation of the engine unit E referring initially to FIG. 2.

The engine unit E incorporates a major housing or block 12 which defines a pair of compound cylinders 6 and 8 that serve both for fuel combustion and hydraulic action. As depicted, the illustrated pair of cylinders 6 and 8 are in a V-configuration, the interiors joining at a common space or volume 10. The compound cylinders 6 and 8 define primary cylinders or combustion chambers 14 and 16 in the upper portions of the V-configuration which are closed at their upper ends by heads 18 and 20, respectively, (considered in greater detail below). At the lower portion of the V-configuration, and in concentric relationship to the chambers 14 and 16, the block 12 also defines a pair of coaxial hydraulic cylinders or chambers 22 and 24, respectively, which communicate with the space or volume 10. Coolant chambers 38 and 40 are also defined somewhat in accord with convention.

A pair of composite piston means 26 and 28 operate individually in each of the cylinders 6 and 8, respectively, of the block 12. The piston means 26 consists of a primary or combustion piston 30 which, though closed at the upper end, is somewhat hollow and is integral with a coaxial solid hydraulic piston 32 that reciprocates in the chamber 22. The piston means 28 consists of a similar combustion piston 34 and an integral concentric solid hydraulic piston 36. In the oscillatory operation of the engine unit E, the piston means 26 and 28 are supplemental in that their relationship is phase opposed, i.e. as one piston means "bottoms out" the other piston means is at the top of a stroke. This relationship is preserved by the inter-related hydraulic forces that effectively intercouple the piston means 26 and 28. Also, in the disclosed embodiment, the piston means 26 and 28 are interconnected by a flexible cable 54; however, in some embodiments, the cable may be eliminated. Generally, the cable serves in the illustrative embodiment to prevent cavitation.

Further related to the operation of the system in a condition of mechanical resonance are a pair of coil springs 42 and 44, the upper ends of which are individually coupled to the piston means 26 and 28, respectively. Specifically, the coil spring 42 is mounted in an annular space 46 that is coaxial with the hydraulic piston 32; the upper end of the spring 42 being fixed to the upper end 48 of the piston means 26 and the lower end of the spring 42 being fixed in the block 12 at the lower end. Similarly, on the other side of the block E, the coil spring 44 is contained in a concentric space 50, with its upper end affixed to the upper ed 52 of the piston means 28, and its lower end affixed in the block 12.

Recapitulating to some extent, the piston means 26 and 28 reciprocate in opposition of phase, motivated by a condition of resonance and as demanded, by expanding gases resulting from the combustion of fuel in one or the other of the combustion chambers 14 or 16. During intervals when the system is idling, the hydraulic pistons 32 and 36 act on a confined body 56 of fluid (in the space 10 and the chambers 22 and 24) which intercouples the piston means 26 and 28 to function in combination with the springs 42 and 44 as a mechanical resonant system. In such a mode of operation, if the stroke amplitude drops below a predetermined level, a charge of fuel is burned to increase the amplitude of oscillations. Otherwise, the system simply oscillates in resonance consuming no fuel.

Upon the occurrence of a demand for the production of power by the motive system, the introduction of fuel charges continues to be highly controlled. The hydraulic pistons 32 and 36 now function partly as a pump, supplying fluid from the space 10 through a closed loop (incorporating the turbine T). Fluid flow from the engine unit E (FIG. 1) to the turbine T is controlled by a valve structure 60 which is considered in greater detail in a subsequent section below.

Figure 2:
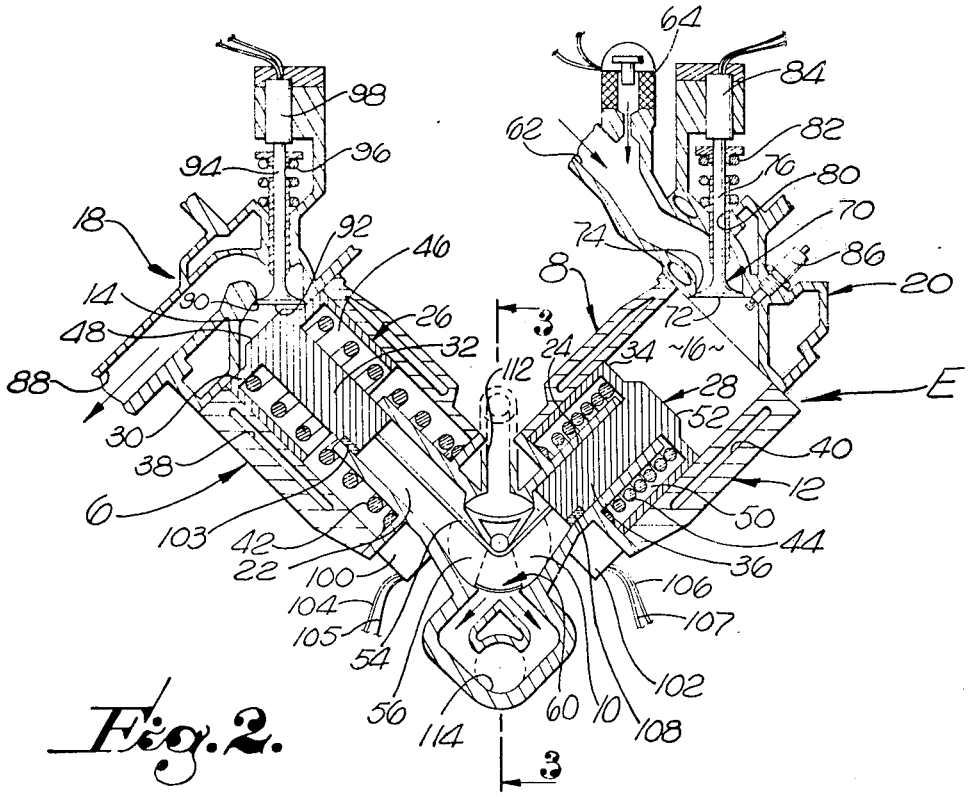
FIG. 2 is a vertical sectional view taken through the engine portion of the system of FIG. 1.

Returning to the engine heads 18 and 20 as indicated above, these structures are exactly alike and are sectioned in FIG. 2 in offset relationship to illustrate the exhaust valve structure in the head 18 and the intake valve structure and ignition in the head 20. With reference to the head 20 (right of V-configuration) initially, a passage 62 is connected to an air intake (not shown) and to an electrical fuel injector 64. In operation, an air-fuel mixture is introduced into the passage 62 to flow through an intake valve 70 into the combustion chamber 16. That is, a valve head 72 sealingly engages the intake port 74 in the head 20 to control the flow of gas charges into the combustion chamber 16. The valve 70 is moved by a stem 76 (integral with the valve head 72) that is slideably received in a bore 80 in the engine head 20, passing concentrically through a closing coil spring 82 and terminating at an electric valve lifter 84 which provides the actual lifting force.

Also affixed in the engine heads, and illustrated in the head 20, is a spark plug 86 serving to ignite combustible charges (fuel and air) in the chamber 16 in a four-cycle sequence of operation. However, there are times when the cycle does not involve a power stroke, i.e. the valve 70 remains closed and the fuel injector 64 along with the spark plug 86 are inoperative.

A similar structure to that described with regard to the head 20 also exists at the left side of the V-configuration, in the head 18, for supplying fuel and ignition to the combustion chamber 14. Exhaust valves and ports are also provided in each head 18 and 20, in association with each of the chambers 14 and 16, as illustrated in association with the chamber 14 (left). Specifically, an exhaust passage 88 (exhausting to ambient) is coupled through an exhaust port 90 to the combustion chamber 14. A valve head 92 at the port 90, is actuated through an integral stem 94 by a concentrically supported spring 96 and an electrical valve lifter 98. The valve lifter 98 along with the other valve lifters are controlled by electrical signals from the control system C (FIG. 1) as described in detail below. Similarly, fuel ignition by spark plugs, e.g. spark plug 86, is also controlled by signals from the control system C along with the fuel injectors, e.g. fuel injector 64.

In the operation of the motive system, it is important that the control system C receive information that is indicative of the current position of the individual piston means 26 and 28. Essentially, the information is provided by magnetic transducers 100 and 102 affixed to the block 12 which sense inserts at sections 103 and 108 of the pistons 32 and 36. A conductor 104 is provided from the transducer 100 for carrying pulses indicative of the progress of the downward stroke (from dead center) by the piston means 26. Similarly, a conductor 106 from the transducer 102 carries pulses indicative of the progress of the piston means 28 downward from dead center. Conductors 105 and 107 receive pulses indicative of the piston means 26 and 28, respectively, crossing dead center during an upward or return stroke.

As indicated above, the control system C also functions to rotate the valve structure 60, thereby regulating the power output from the motive system in accordance with current demand. As generally indicated in FIG. 2, hydraulic chambers 22 and 24 are integral with the space 10 as better illustrated in FIG. 4. As shown in that FIG., the space 10 is partially defined by a cylindrical valve body 110 that is a rigid part of the block 12. The valve 60 rotates reciprocally in the valve body 110 from the position illustrated in FIG. 4a to allow external hydraulic flow. When the valve 60 is displaced, the space 10 in the valve body 110 receives low pressure fluid through a duct 112 and exhausts high pressure fluid through a duct 114 to drive a fluid turbine T as indicated above. During intervals of idling operation, the valve 60 is closed (FIG. 4*a*) with the result that the body of fluid confined between the hydraulic pistons 32 and 36 in the space 10 serves simply as a force coupling to accomplish oscillation at a resonant frequency. Structurally the valve 60 includes a concentrically-mounted rotary shaft 118 which carries diametrically-opposed radial valve members 120 and 124. The upper valve member 120 defines an arcuate surface, the tips of which engage the valve body 110 to close a port 126 to the duct 112. Somewhat similarly, the valve member 124 terminates in an arcuate surface to close a port 128 in communication with the duct 114. When operated, the valve 60 is actuated by an oscillating electric motor 136 (FIG. 3) energized by the control system C.

During intervals when the motive system delivers power, the valve 60 is opened by rotating either counterclockwise (FIG. 4*b*) or clockwise (FIG. 4*c*) on the shaft 118. The counterclockwise rotation of the shaft 118 occurs during a power stroke in the hydraulic chamber 24 (right). As a consequence, fluid flows from the chamber 24 into the chamber 22, as indicated by the arrow 130, and through the port 128, as indicated by the arrow 132. Concurrently, relief fluid flows from the duct 112 into the chamber 22, as indicated by the arrow 133. Upon an alternate power stroke, the valve 60 is rotated clockwise (FIG. 4c) with the result that power fluid moves from the chamber 22 through the port 128 and into the chamber 24, while relief fluid flows from the duct 112 into the chamber 24.

The power fluid exhausting through the port 128 (FIG. 4*a*) moves through one of a pair of exhaust passages 135 or 137 (depending upon the displacement of the valve 60) to pass to the high-side duct 114. The passages 135 and 137 are separated by a relief valve structure 139 which includes a pair of pivotally-mounted flap valves 141 and 143, connected together by a coil spring 145. The relief valve structure 139 functions to avoid cavitation. That is, if the pressure in one of the passages 135 or 137 drops to a point where cavitation might occur, one of the flap valves 141 or 143 opens to allow fluid from the valve structure 139 (connected to the low side, e.g. duct 112) to relieve the condition. A related optional structure, the cable 54, in addition to avoiding excessive amplitude, avoids cavitation by maintaining a constant volume of operating fluid.

Figure 3:
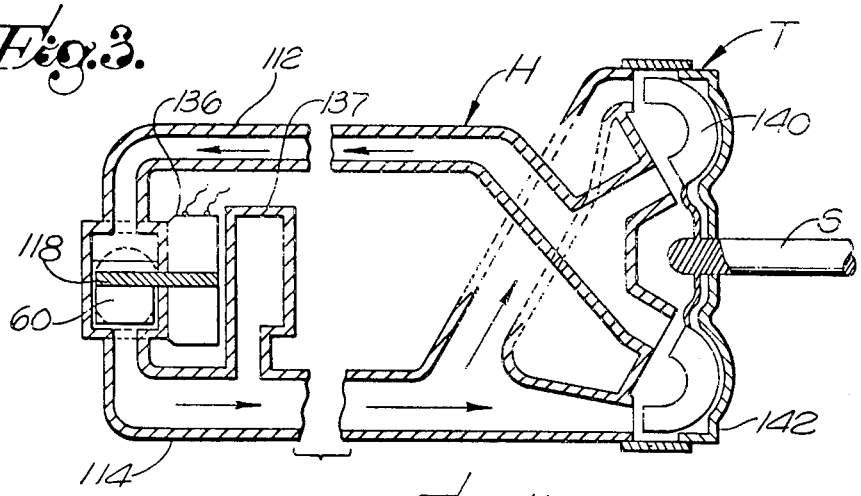
FIG. 3 is a vertical sectional view taken through the central lower portion of the structure of FIG. 2.

Considering the closed flow path from the valve 60 to the turbine T, reference will now be had to FIG. 3 showing details of the hydraulic ducts H. High-side fluid (pressure-velocity) flows from the valve 60 through the duct 114 (incorporating a hydraulic accumulator 137) to the exterior of the turbine T incorporating a wheel or rotor 140 in a housing 142, various forms of which are well known in the art of turbomachinery. The rotor 140 is coupled to the shaft S, which it actuates in the process of removing energy from fluid received through the duct 114. Spent fluid is returned to the valve 60 through the duct 112 to close the hydraulic system.

Summarizing the description to this point, it is to be appreciated that the disclosed motive system burns fuel to accomplish supplemental displacement of a pair of resilient pistons which mutually act through a body of hydraulic fluid to oscillate at resonant frequency. Power output from the system is provided in the form of pressurized hydraulic fluid when the reciprocating pistons operate partly as pumps. Hydraulic fluid is circulated through a closed path which includes a rotary turbine T in the disclosed embodiment to provide mechanical output power.

As suggested above, a system in accordance herewith requires somewhat precise control for effective operation. The illustrative embodiment incorporates an electrical control system C (FIG. 1) which receives information indicative of piston position, power demand and power delivered and accordingly controls the burning of fuel and the flow of hydraulic fluid from the engine E to the turbine T. As suggested above, and emphasized here, the system hereof might well take the form of any internal-combustion engine (Otto cycle or Diesel cycle) or other forms of gas expansion engines, e.g. compressed air or steam.

Figure 5:
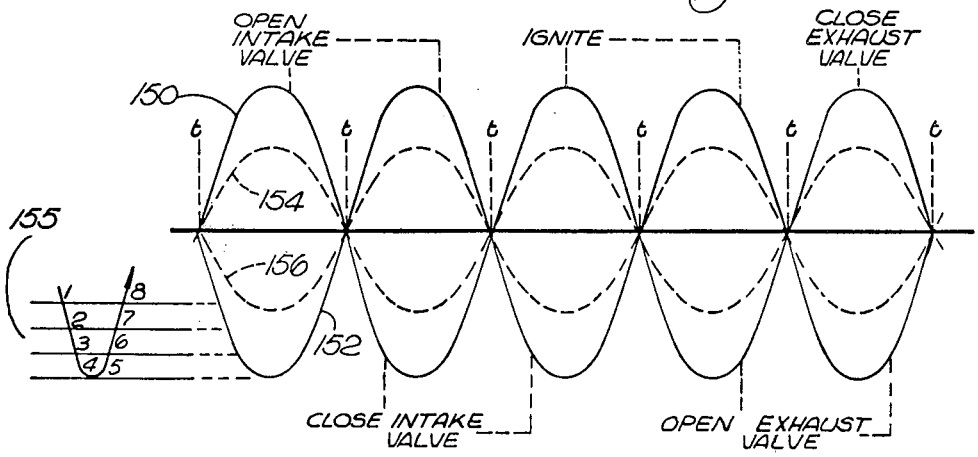
FIG. 5 is a cyclic waveform diagram employed in the explanation of the operation of the system of FIG. 1.

Returning to a detailed consideration of the illustrative embodiment, the piston motion may be described by the waveforms of FIG. 5. Specifically, the oscillatory motion of the piston means 26 is described by the waveform 150 while the motion of the piston means 28 is described by the waveform 152. It is to be noted that the pistons are aligned at locations of equal displacement (dead center) at the cross-over points of the curves, indicated as time *t*, which is manifest by a pulse t occurring each one-half cycle and variously derived, as for example by any "dead-center" sensor as may be incorporated in the transducers 100 and 102. A full cycle is represented as a time T.

The waveforms 150 and 152 indicate a maximum amplitude or stroke displacement of the piston means 26 and 28. Dashed-line curves 154 and 156 indicate amplitudes or displacements of lesser magnitude, however, in which resonant frequency is preserved. Generally, when the system is in an idling state, the piston means 26 and 28 oscillate at a somewhat lower amplitude, e.g. approaching the curves 154 and 156. It will be recalled that if the amplitude or stroke displacement drops below a predetermined level, a fuel charge is burned to restore the oscillations to a satisfactory level of amplitude. During the production of output power, the system continues to oscillate at the resonant frequency; however, piston displacement or amplitude may increase, e.g. approaching the curves 150 and 152.

In the diagram of FIG. 5, the vertical dashed lines designate instants of valve movement and ignition associated with the two piston means 26 and 28. In that regard, the illustrative system is a four-cycle engine as will be apparent from the diagram of FIG. 5. The magnetic transducers 100 and 102 (FIG. 2) serve to provide pulses position-indicative information on the piston means 26 and 28. However, in view of the substantially-constant frequency of operation, timing of the various control functions is somewhat simplified.

During positive-going excursions of the curves 150 and 152 (representing piston motion) the pulse t is provided upon crossing the reference level 157 (dead center). The negative-going excursions of the waveforms (representing piston down strokes from dead center) results in a number of pulses *p* (a maximum of eight) depending upon the amplitude of the excursion (extent of the stroke). If a maximum stroke displacement occurs, 8 pulses *p* are provided as indicated by the diagram 155 associated with the waveforms 150 and 152. The waveform 156 would result in the generation of less than four pulses p in accordance with the operation of the transducers 100 and 102. A variety of specific transducers or sensing devices may be incorporated in the magnetic transducer structures 100 and 102 as well known in the prior art to provide pulses as indicated.

Referring to FIG. 6, the control system C is illustrated which receives the pulses p and t from the magnetic transducers along with signals representative of power demand to time power strokes as required. The pulses p, from the transducers 100 and 102 (bottom) drive a pair of counters 202 and 204 which indicate the current position of the piston means 26 and 28. Generally, the counters 202 and 204 are cleared or reset during a positive-going portion of an associated piston stroke by the first pulse p generated by the opposed piston in a negative-going portion of a stroke. The counters accumulate pulses p during a negative-going stroke to digitally indicate the displacement or stroke on a scale of "8".

The counters 202 and 204 provide information that is variously employed depending upon the current operating conditions of the system. For example, in the event that the system is simply idling, the counters 202 and 204 inhibit the burning of fuel unless or until the stroke length drops below an amplitude productive of four output pulses p as indicated with respect to the diagram 155 of FIG. 5. Should the engine be operating in a power-producing mode, the counters 202 and 204 inhibit the burning of fuel only when the engine attains full-stroke displacement. Otherwise, fuel is burned, provided that a comparison (by a comparator 206, upper left) of signals from the power demand unit D and power delivery transducer 210 indicates unsatisfied power demand.

Generally, the input information to the control system in the final analysis serves to control a sequence unit 212 (upper center) which provides individual signals for actuating various components of the system including: fuel injectors, intake valves, exhaust valves and spark plugs. Considering the control system of FIG. 6 in somewhat greater detail, the pulses t are connectively applied to synchronize the sequence unit 212. The timing pulses p are applied through trigger circuits 214 and 216, respectively, to reset and advance the counters 202 and 204. The trigger circuits 214 and 216 may comprise various forms of triggers or pulse shapers as well known in the prior art including forms of Schmitt triggers.

The shaped pulses p from the triggers 214 and 216 are tallied by the counters 202 and 204, respectively, which each comprise four-stage binary units. The individual stages are assigned conventional binary significance, e.g. "1", "2", "4", and "8". The two most-significant digit stages ("4" and "8") of the counters 202 and 204 are connected through "nor" gates 218 and 220, respectively, to "and" gates 222 and 224 which actuate monostable multivibrators 230 and 232. The gates 222 and 224 as well as the other logic elements associated with the counters 202 and 204 are generally supplemental in the sense that the system provides operating signals for each of the two cylinders 6 and 8 as illustrated in FIG. 2. In that regard, the operation of the control system C involves resolving existing conditions to determine the times and cylinders in which to burn charges of fuel.

During the idling state, the nor gates 218 and 220 in combination with the and gates 222 and 224 serve to inhibit a power stroke as long as the pistons 26 and 28 are operating at a displacement to indicate a level of 4 or more in the counters 202 and 204. That is, in the event one of the counters 202 or 204 attains a count of binary 4 the associated nor gate 218 or 220 will provide a low level (inhibiting) signal to an associated one of the gates 222 or 224. Conversely, qualification of the and gates 222 or 224 initiates a power stroke. These gates must also be qualified by the initial signal p as well as an inverse feedback signal that is provided through inverters 226 and 228. Qualification of the and gate 222, for example, occurs during the first of the pulses *p* and when the counter 202 indicates a piston displacement below 4 providing the gate 222 is not inhibited by a monostable multivibrator 230 acting through an inverter 226. Upon qualification of the and gate 222, a monostable multivibrator 232 is actuated to provide a delay of slightly over two cycles, e.g. 9/4 T. The multivibrator 232 then provides a high output which is inverted by the inverter 228 so as to inhibit the gate 224 from operation. Thus, it may be seen that if the engine is operating at a displacement below the level of 4 (on the scale indicated in FIG. 5) during a timing interval indicated by the pulse *t*, one of the multivibrators 230 or 232 will be set to initiate a power stroke in the manner as will now be explained further.

The high-level binary signals from the multivibrators 230 and 232 are applied to or gates 234 and 236, respectively, the outputs of which in turn are applied to and gates 238 and 240, respectively, for providing power-stroke signals to the sequencer unit 212. The and gates 238 and 240 also receive signals through inverters 242 and 244, respectively, from monostable multivibrators 246 and 248 (having a period of 2T) which are actuated upon a count of 8 in either of the counters 202 or 204. Thus, the and gates 238 and 240 impose a final test on the process of initiating a power stroke to assure that piston displacement is below the level of 8 in the scale of the counters 100 and 102.

The or gates 234 and 236 each have two separate inputs. For example, the or gate 234 (controlling piston 26) receives one input from the multivibrator 230, which is high when a power stroke is desired, as during an idling state. The other input to the or gate 234 is from an and gate 252, which is high when current power demands indicate the need for a power stroke. Although either input to the or gate 234 indicates the need of a power stroke, such an indication is voided unless the gate 238 is qualified by a signal from the inverter 242, indicating that the current displacement is below less than an amplitude of 8. The operation of the or gate 236 controlling the ignition of a fuel charge to act on the piston 28 is similar. In that regard, the or gate 236 receives an idling-state command signal from the multivibrator 232, and a power-state command signal as will now be described.

The power-state command signals provided to the or gates 234 and 236 are developed at the and gates 252 and 256 having opposed inputs from a flip flop 254 and a common input from the comparator 206. A high signal from the comparator 206 indicates an unfulfilled demand for power. Upon such an occurrence, the question arises as to which of the pistons 26 or 28 is best positioned to initiate a power stroke. That determination is resolved by the sequence unit 212 driving the flip flop 254 in an alternating pattern, synchronized by the signals t from the transducers 100 and 102. If the piston 26 is best positioned to initiate a power stroke, the flip flop 254 is set to qualify the and gate 252. Conversely, if the piston 28 is in a preferred position, the flip flop 254 provides a qualifying high signal to the and gate 256.

Depending upon which of the or gates 234 or 236 receives a high signal, one of the and gates 238 or 240 is qualified, assuming the amplitude of oscillation is below 8. Thereupon, a high signal is provided to one of the "GO" inputs of the sequence unit 212. Depending upon which of these inputs receives a high signal, a series of timed operating signals are provided to one or the other of the cylinders 6 or 8 to result in a power stroke. Thus, each fuel charge burned in the motive system is fully controlled and timed.

Figure 4:
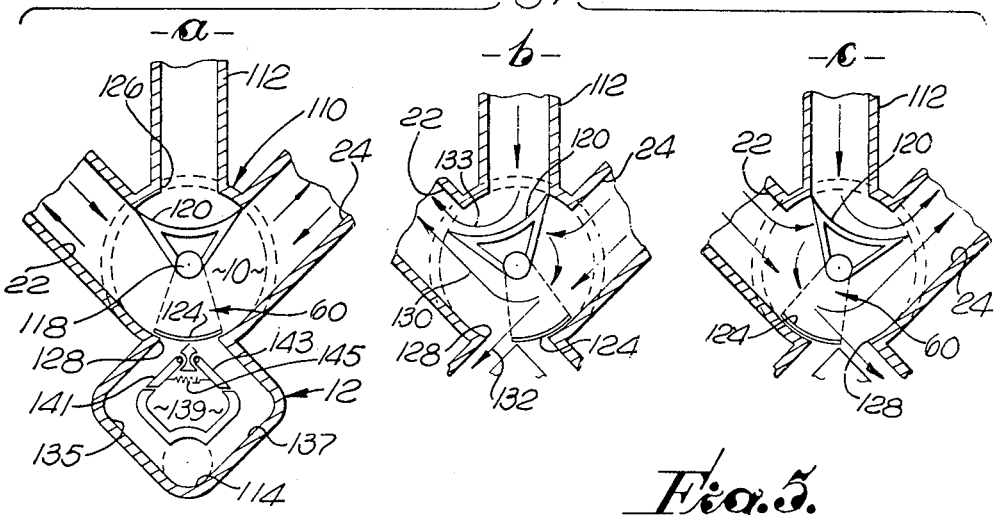
FIG. 4 is an enlarged series of staged structural representations similar to a portion of FIG. 3, which are illustrative of the operation of a portion of the system of FIG. 1.

In addition to controlling the individual engine operations, e.g. fuel injection, valve operation and ignition, the control system C also controls the hydraulic valve 60 (FIG. 2). Specifically, as explained above, the valve 60 rotates during power operation and remains fixed while the system is idling (FIG. 4). The oscillatory rotation is commanded by signals form a pair of and gates 260 and 262 (FIG. 6 upper center) each of which receives one input from the sequence unit 212, and another input from an and gate 264 which is qualified when a demand for power exists. Specifically, when the comparator 206 indicates that the power demand (conductor 271) is greater than the power generated (signal from monitoring transducer 210) a high level signal is provided to the and gate 264. Also, the re-triggerable monostable multivibrator 266 which has a period of T/2, provides a high signal through an or gate 268 upon the occurrence of a count of 4 or more in either of the counters 202 or 204. If the count of 4 or more is repeatedly reached, the output of the multivibrator 266 remains constantly high. Thus, upon qualification of the and gate 264, one of the and gates 260 or 262 is qualified to actuate the valve 60. It is to be noted that the gates 260 and 262 are qualified to open the hydraulic valve 60 toward the cylinder in which a power stroke occurs at the time of opening.

The description herein has been directed to an operating motive system which may be seen to have the advantages and features set out at the introduction. With regard to starting the system, various techniques may be employed as will be apparent to one skilled in the art of reciprocating machinery. For example, a source of hydraulic fluid under pressure may be employed in cooperation with the valve 60 and an auxiliary control therefor, to initiate oscillatory motion of the piston means 26 and 28. After such oscillatory motion is established, the source of fluid under pressure is withdrawn and the system simply resonates in an idling state. Of course, upon the amplitude of oscillations dropping below a predetermined level as explained above, a charge of fuel is ignited to initiate a power stroke increasing the amplitude of oscillations. Also as indicated above, in the event that the system is called upon to provide output power, then fuel charges are ignited alternately in the cylinders to establish a steady state operation.

It now becomes obvious to anyone skilled in the art, from the above disclosure of one preferred embodiment, that a principal feature of this invention consists in the method of converting thermal energy into hydraulic (mechanical) energy. Therefore, it also is obvious that the structure of the disclosed embodiment, being only a particular case of a much more general class of engines, is dominated by said method itself. Consequently, a further description of the major features of the method is perhaps appropriate.

Figure 7:
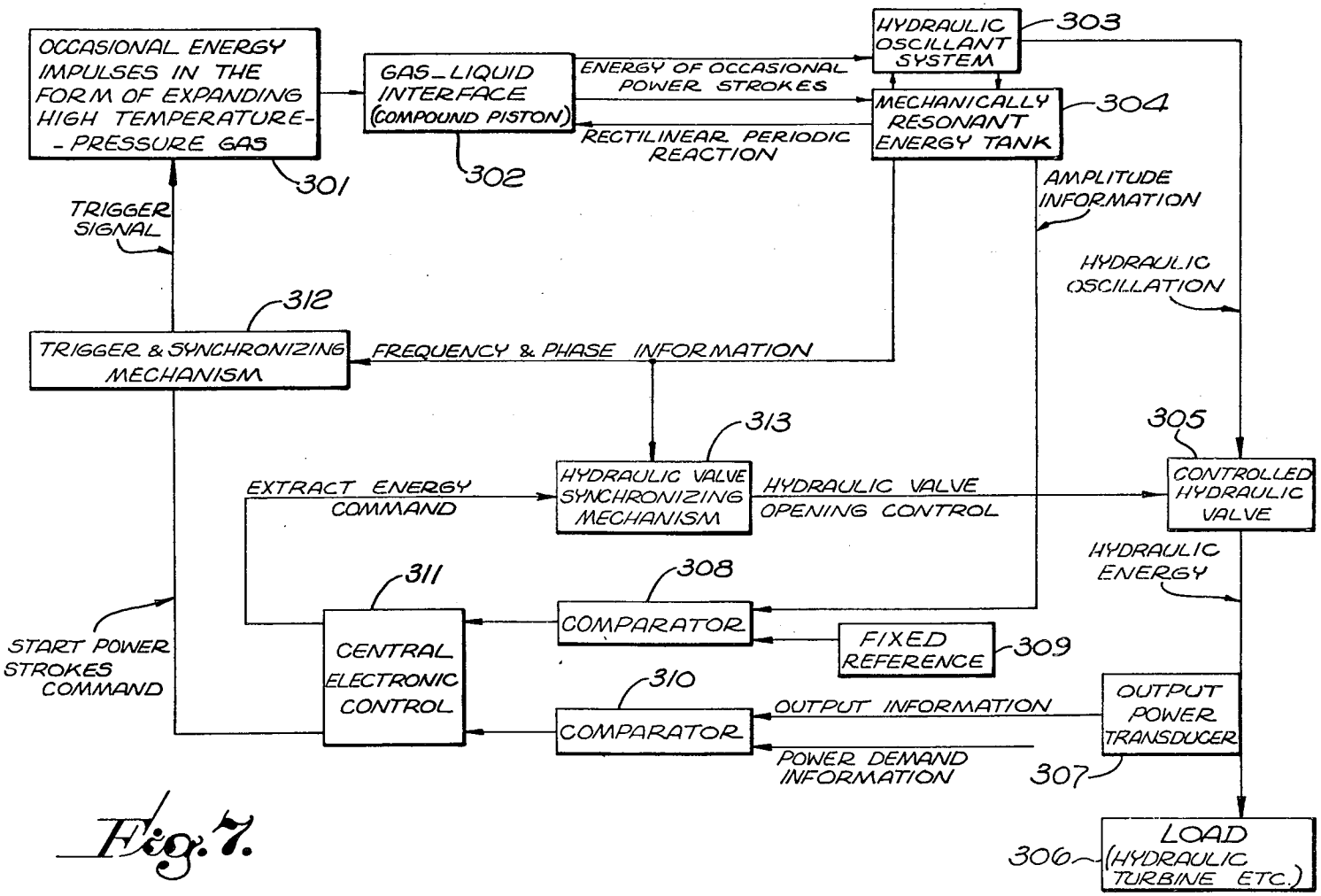
FIG. 7 is an explanatory diagram illustrative of the system of the present invention.

A diagram of the flow and conversion of energy, as well as of the flow of information to release and control that energy is provided by FIG. 7. A thermodynamic process occurs in the combustion, or simply expansion, chambers of the engine and results in energy impulses in the form of expanding high temperature-pressure gas which enters the system at block 301. These impulses of energy may be irregular, occasional, and are a direct consequence of a trigger signal which starts an active cycle. It should be understood that the active cycle could consist of admission and subsequent expansion of pressurized (hot) steam or of some other working fluid;

the active cylce could also be due to internal combustion of a constant charge of fuel, in an Otto or self-ignition cycle as known in the art.

The first conversion of the said energy impulse occurs at block 302 which represents the general case of a gas-liquid interface achieved by a compound piston. Indeed, at this level the energy of every gas expansion is transferred to the liquid in the hydraulic system in a direct way, by a rectilinear motion of said piston. It can easily be seen that this conversion is highly efficient due to the minimal losses of a rectilinear motion with minimal lateral forces acting against the cylinder walls. The hydraulic energy which appeared at block 302 is transferred to a hydraulic oscillant system at block 303; the latter may consist of the supplemental hydraulic working chambers and pistons and the passage ways between them. The same impulses of hydraulic energy, along with the energy of the moving mass, set in motion the mechanically resonant system which results from interaction with the resiliency of springs or similar elastic means mounted between the mobile and stationary parts of the engine. In virtue of basic physical principles, any such mechanically resonant system is a tank of energy, represented by block 304. Indeed, once set in oscillating motion, the system will oscillate for a relatively long time without new additions of external energy. The resonant energy tank (block 304) interacts with, and is partly superimposed to, the hydraulic oscillating system 303; this is shown by the two-way arrows between the two. There is also a two-way interaction with the gas-liquid interface, block 302, in that the resonant system keeps moving the compound piston also between power strokes (energy impulses) due to the periodic reaction known to occur in any resonant system. Therefore, at the level of blocks 302, 303 and 304 the irregular impulses of energy are converted into a periodic, regular motion which keeps the gas-liquid interface means in linear oscillation; this oscillation can provide the pumping energy necessary to work an internal combustion cycle such as Otto or Diesel.

When the rate of energy impulses from block 301 is high enough to provide a total energy larger than what is absorbed in friction losses and pumping work, the excess (energy) is extracted from the hydraulic oscillating system by timed opening of a controlled hydraulic valve, at block 305. At this level the oscillating hydraulic energy is converted into continuous flow which is utilized at a load, block 306, which may be a hydraulic turbine to convert the energy into mechanical rotation. Obviously, the load could be any other kind of hydraulic machinery including reciprocating devices. So far, the flow and conversion of energy has been described assuming that all processes are well coordinated. In order to achieve that coordination, however, a control system to process information at all times is needed.

The first problem in a system such as described is to constantly maintain the resonant oscillation. To that effect, the resonant energy tank, block 304, provides information regarding the amplitude of the oscillation, which enters comparator 308 to be checked against the information coming from the fixed reference 309. Any time the amplitude of oscillation drops below the reference, the comparator 308 will give a signal to the central electronic control at block 311 to start active cycles to restore said amplitude. This process occurs whether the engine is delivering power or idling and could be the only control of the system. The same would require, however, an initial decrease in the amplitude of oscillation before increasing the power output. To avoid this unwanted delay, an output-power transducer at block 307 provides information to be compared with the power demand (desired power) in comparator 310. The latter can thus provide a signal to the central electronic control, block 311, before the amplitude of oscillations has decreased. This way active cycles are started immediately following a command for increased output power.

The command to start power strokes, from block 311, is processed through a synchronizing mechanism at block 312, which provides the trigger signals for active cycles. This mechanism receives information concerning the frequency and phase of the resonant motion in order to provide synchronized sequenced triggers. The loop energy-information-energy is thus closed as the trigger signal reaches block 301.

The central control at block 311 also commands the extraction of hydraulic energy through the hydraulic valve synchronizing mechanism at block 313 and the hydraulic valve itself at block 305. This additional loop lets energy be extracted only when the conditions in the whole system are proper.

To summarize, the method utilizes occasional impulses of energy to keep oscillating a resonant energy tank and to convert that energy into more regular hydraulic flow which eventually provides mechanical energy. The whole process is controlled by information-processing devices which close the loop and thus achieve one of the most rational ways to convert heat into mechanical work. The burning of constant amounts of fuel for each of the active cycles, which may occur at an irregular rate, offers the cleanest way to consume the chemical energy.

As indicated above, the system hereof may be variously embodied in a variety of different expansion engines using power provided by such engines in an oscillatory-motion mode to deliver output power in the form of hydraulic fluid under pressure. The system has substantial inherent advantages by reason of its efficiency, simplicity and adaptability to existing engine configurations. Of course, in view of the wide number of possible variations for the system the scope hereof shall be as defined in the claims set forth below.

What is claimed is:

1. A method of operating a gas expansion engine during intervals of idling and power-providing operation, having resiliently-mounted displacement-related pistons to provide motive power, comprising the steps of:

establishing a resonant frequency of oscillating motion for said pistons as the operating frequency for the engine;

sensing the amplitude of the oscillating motion of said pistons;

selectively actuating power strokes by each of said pistons during idling intervals of operation upon the amplitude of oscillating motion dropping below a predetermined level and otherwise during power-providing intervals of operation to provide motive power.

2. A method according to claim 1 including the step of inhibiting power strokes during power operation unless the amplitude of the oscillatory motion is below a certain level.

3. Method for the operation of a reciprocating engine having a stationary structure supporting pistons mounted for rectilinear motion, and elastic means for acting on said pistons comprising the steps of:

oscillating the pistons at the frequency of mechanical resonance defined by the mass of said pistons in rectilinear motion in conjunction with the force provided by said elastic means acting between the pistons and the stationary structure to temporarily store energy;

irregularly driving certain of said pistons during power strokes to maintain said pistons oscillating at said frequency of mechanical resonance.

4. Method according to claim 3 further including the step of translating said energy into hydraulic energy.

5. A control system for an expansion engine including pistons wherein power strokes are controlled to occur at particular times, comprising:

means for providing a power signal indicative of the stroke amplitude of said pistons;

means for providing a power signal indicative of a demand for power;

signal-controlled means for commanding a power stroke in said engine;

means for actuating said signal-controlled means in the absence of said power signal, at a time when said stroke signals indicate a stroke amplitude below a predetermined minimal level; and means for actuating said signal-controlled means upon the occurrence of said power signal conditional upon said stroke signals indicating a stroke amplitude below another predetermined maximal amplitude.

6. A system according to claim 5 further including means for timing the initiation of a power stroke in relation to the position of said pistons and actuated by said signal-controlled means.

* * * * *